US005518649A

United States Patent [19]

Chapple et al.

[11] Patent Number: 5,518,649

[45] Date of Patent: May 21, 1996

[54] PARTICULATE DETERGENT COMPOSITION OR COMPONENT COMPRISING ZEOLITE MAP ASA CARRIER

[75] Inventors: Andrew P. Chapple, Wrexham; Willaim D. Emery, Wirral; Peter C. Knight, South Wirral, all of England

[73] Assignee: Lever Brothers Company, Division of Conopco, Inc., New York, N.Y.

[21] Appl. No.: 514,475

[22] Filed: Aug. 11, 1995

Related U.S. Application Data

[63] Continuation of Ser. No. 252,638, Jun. 2, 1994, abandoned, which is a continuation of Ser. No. 903,697, Jun. 24, 1992, abandoned.

[30] Foreign Application Priority Data

Jun. 25, 1991 [GB] United Kingdom ..... 9113675

[51] Int. Cl.[6] ..... C11D 11/00; C11D 3/12; C11D 17/06

[52] U.S. Cl. ..... 252/174.25; 252/89.1; 252/174; 252/174.13; 252/174.21; 252/DIG. 1

[58] Field of Search ..... 252/174.25, 174, 252/21, DIG. 1, DIG. 11, 174.13, 89.1, 174

[56] References Cited

U.S. PATENT DOCUMENTS

| | | | |
|---|---|---|---|
| 3,112,176 | 11/1963 | Haden, Jr. et al. | 23/113 |
| 3,769,222 | 10/1973 | Yurko et al. | 252/DIG. 1 |
| 4,639,326 | 1/1987 | Czempik et al. | 252/91 |
| 4,648,882 | 3/1987 | Osberghaus et al. | 8/142 |
| 4,652,391 | 3/1987 | Balk | 252/99 |
| 4,675,124 | 6/1987 | Seiter et al. | 252/91 |
| 4,707,290 | 11/1987 | Seiter et al. | 252/140 |
| 4,713,193 | 12/1987 | Tai | 252/91 |
| 4,820,436 | 4/1989 | Andree et al. | 152/544 |
| 5,238,594 | 8/1993 | Chapple | 252/95 |
| 5,259,981 | 11/1993 | Chapple et al. | 252/95 |
| 5,259,982 | 11/1993 | Chapple et al. | 252/95 |
| 5,374,370 | 12/1994 | Brown et al. | 252/174.25 |

FOREIGN PATENT DOCUMENTS

| | | |
|---|---|---|
| 0038591 | 10/1981 | European Pat. Off. . |
| 0050897 | 5/1982 | European Pat. Off. . |
| 0149264 | 7/1985 | European Pat. Off. . |
| 0384070 | 8/1990 | European Pat. Off. . |
| 0448297 | 9/1991 | European Pat. Off. . |
| 2620293 | 11/1977 | Germany . |
| 1504211 | 3/1978 | United Kingdom . |

OTHER PUBLICATIONS

EP Search Report EP 92 30 5590, Nov. 18, 1992.
GB Search Report 9113675.4, Nov. 18, 1992.

*Primary Examiner*—Paul Lieberman
*Assistant Examiner*—Ardith Hertzog
*Attorney, Agent, or Firm*—Rimma Mitelman

[57] ABSTRACT

A free-flowing particulate detergent composition or component therefor comprises (i) a particulate carrier material comprising from 10 to 100 wt % (anhydrous basis) of maximum aluminum zeolite P (zeolite MAP), and (ii) a liquid, viscous-liquid, oily or waxy detergent ingredient, for example, a nonionic surfactant, the weight ratio of the ingredient (ii) to the zeolite MAP being at least 0.01:1, preferably 0.01:1 to 1.4:1, and more preferably from 0.1:1 to 1:1.

16 Claims, No Drawings

PARTICULATE DETERGENT COMPOSITION OR COMPONENT COMPRISING ZEOLITE MAP ASA CARRIER

This is a continuation or application of Ser. No. 08/252,638, filed Jun. 2, 1994, now abandoned, which is a continuation of Ser. No. 07/903,697, filed Jun. 24, 1992, now abandoned.

TECHNICAL FIELD

The present invention relates to a free-flowing particulate detergent composition, or component therefor, containing crystalline alkali metal aluminosilicate (zeolite) and also including a liquid, viscous-liquid, oily or waxy ingredient.

BACKGROUND AND PRIOR ART

The ability of crystalline alkali metal aluminosilicate (zeolite) to sequester calcium ions from aqueous solution has led to its becoming a well-known replacement for phosphates as a detergency builder. Particulate detergent compositions containing zeolite are widely disclosed in the art, for example, in GB 1 473 201 (Henkel), and are sold commercially in many parts of Europe, Japan and the United States of America.

Although many crystal forms of zeolite are known, the preferred zeolite for detergents use has always been zeolite A: other zeolites such as X or P(B) have not found favour because their calcium ion uptake is either inadequate or too slow. Zeolite A has the advantage of being a "maximum aluminium" structure containing the maximum possible proportion of aluminium to silicon—or the theoretical minimum Si:Al ratio of 1.0— so that its capacity for taking up calcium ions from aqueous solution is intrinsically greater than those of zeolite X and P which generally contain a lower proportion of aluminium (or a higher Si:Al ratio).

EP 384 070A (Unilever) describes and claims a novel zeolite P (maximum aluminium zeolite P, or zeolite MAP) having an especially low silicon to aluminium ratio, not greater than 1.33 and preferably not greater than 1.15. This material is demonstrated to be a more efficient detergency builder than conventional zeolite 4A.

U.S. Pat. No. 3,112,176 (Haden et al/Minerals & Chemicals Philipp Corporation) relates to the preparation, from metakaolin, of a novel zeolite having a silicon to aluminium ratio of approximately 1:1, an exceptionally high base exchange capacity, and a very high oil absorption capacity. The zeolite is defined by an X-ray diffraction pattern which is that characteristic of zeolite P. The material contains a relatively high level of titanium impurity (derived from the metakaolin starting material). Suggested uses are for water treatment in the chemical industry and in sugar production, and as a pigment or filler in the production of plastics and rubber goods.

The use of zeolite A in detergent compositions as a carrier for liquid ingredients such as nonionic surfactants has also been disclosed in the art; for example, GB 1 504 211 (Henkel) discloses the use of zeolite A powder as a possible carrier material for nonionic surfactants. EP 149 264A (Unilever) discloses a spray-dried granular material, based on zeolite A, for carrying large loadings of liquid, viscous-liquid, oily or waxy detergent components, for example nonionic surfactants: the resulting "adjuncts" are free-flowing powders.

It has now unexpectedly been found that zeolite MAP, both in powder form and when granulated with or without other materials, is substantially superior to zeolite A as a carrier for liquid, viscous-liquid, oily or waxy detergent ingredients such as nonionic surfactants, allowing the preparation of stable free-flowing powders containing high proportions of such ingredients.

DEFINITION OF THE INVENTION

The present invention provides a free-flowing particulate detergent composition or component therefor, which comprises (i) a particulate carrier material comprising from 10 to 100 wt % (anhydrous basis) of zeolite MAP, and (ii) a liquid, viscous-liquid, oily or waxy detergent ingredient, the weight ratio of the ingredient (ii) to the zeolite MAP being at least 0.01:1.

DETAILED DESCRIPTION OF THE INVENTION

The subject of the invention is a free-flowing particulate composition which may be a complete detergent product in its own right, or a component of a more complex product. The invention arises from the observation that the absorption and carrying capacity of zeolite MAP for liquid, viscous-liquid, oily or waxy ingredients is unexpectedly good compared with that of zeolite A.

The composition or component of the invention has two essential ingredients: the particulate carrier material (i), and the adsorbed liquid, viscous-liquid, oily or waxy ingredient (ii) carried. Other detergent ingredients may also be present if required or desired.

The ratio of the ingredient (ii) to the zeolite MAP is at least 0.01:1, preferably from 0.01:1 t6 1.4:1, and may advantageously lie within the range of from 0.01:1 to 0.75:1. It is preferably at least 0.1:1, and advantageously at least 0.35:1, more advantageously at least 0.45:1, and may be as high as 1:1 or even 1.4:1; but compositions having lower ratios that do not utilise the full carrying capacity of zeolite MAP are also within the scope of the invention. The ratio most preferably lies within the range of from 0.1:1 to 1:1.

Compositions and components in accordance with the invention suitably contain from 2 to 45 wt % of the ingredient (ii), based on the total of the particulate carrier material (i) and the ingredient (ii).

The particulate carrier material

The particulate carrier material consists wholly or partially of zeolite MAP.

Zeolite MAP

Zeolite MAP (maximum aluminium zeolite P) and its use in detergent compositions are described and claimed in EP 384 070A (Unilever). It is defined as an alkali metal aluminosilicate of the zeolite P type having a silicon to aluminium ratio not greater than 1.33, preferably within the range of from 0.9 to 1.33, and more preferably within the range of from 0.9 to 1.2.

Of especial interest is zeolite MAP having a silicon to aluminium ratio not greater than 1.15; and zeolite MAP having a silicon to aluminium ratio not greater than 1.07 is especially preferred.

Zeolite MAP generally has a calcium binding capacity of at least 150 mg CaO per g of anhydrous aluminosilicate, as measured by the standard method described in GB 1 473 201 (Henkel) and also described, as "Method I", in EP 384 070A (Unilever). The calcium binding capacity is normally at least 160 mg CaO/g and may be as high as 170 mg CaO/g. Zeolite MAP also generally has an "effective calcium binding capacity", measured as described under "Method II" in EP 384 070A (Unilever), of at least 145 mg CaO/g, preferably at least 150 mg CaO/g.

Although zeolite MAP like other zeolites contains water of hydration, for the purposes of the present invention amounts and percentages of zeolite are generally expressed in terms of the notional anhydrous material. The amount of water present in hydrated zeolite MAP at ambient temperature and humidity is normally about 20 wt %.

Particle size of the zeolite MAP

Preferred zeolite MAP for use in the present invention is especially finely divided and has a $d_{50}$ (as defined below) within the range of from 0.1 to 5.0 micrometers, more preferably from 0.4 to 2.0 micrometers and most preferably from 0.4 to 1.0 micrometers.

The quantity "$d_{50}$" indicates that 50 wt % of the particles have a diameter smaller than that figure, and there are corresponding quantities "$d_{80}$", "$d_{90}$" etc. Especially preferred materials have a $d_{90}$ below 3 micrometers as well as a $d_{50}$ below 1 micrometer.

Various methods of measuring particle size are known, and all give slightly different results. In the present specification, the particle size distributions and average values (by weight) quoted were measured by means of a Malvern Mastersizer (Trade Mark) with a 45 mm lens, after dispersion in demineralised water and ultrasonification for 10 minutes.

Advantageously, but not essentially, the zeolite MAP may have not only a small average particle size, but may also contain a low proportion, or even be substantially free, of large particles. Thus the particle size distribution may advantageously be such that at least 90 wt % and preferably at least 95 wt % are smaller than 10 micrometers; at least 85 wt % and preferably at least 90 wt % are smaller than 6 micrometers; and at least 80 wt % and preferably at least 85 wt % are smaller than 5 micrometers.

Zeolite MAP powder

According to a first embodiment of the invention, the carrier material is simply zeolite MAP in powder form. Powdered zeolite MAP has been found to be an excellent carrier material: for example, the amount of mineral oil (g per g anhydrous zeolite) that it can take up before losing its free-flowing character is has been found to be from 1.2 to 1.9 times as great as the corresponding amount for commercial zeolite A powders.

If desired, other detergent ingredients in powder form may be present in admixture with the zeolite MAP powder.

Zeolite MAP in granular form

The particle size of zeolite MAP powder is small, and the material may be more conveniently handled if granulated, by spray-drying or by a non-tower method, to form larger particles.

Granular materials of this type based on zeolite A are well-known and are sold commercially, for example, as Wessalith (Trade Mark) CS and CD by Degussa AG, Germany.

In a second embodiment of the invention, therefore, the carrier material is a granulate comprising from 10 to 80 wt %, preferably from 50 to 80 wt %, of zeolite MAP.

As well as spray-dried granulates, the second embodiment of the invention encompasses granular carrier materials prepared by non-tower processes such as dry mixing and granulation.

Compositions according to the first and second embodiments of the invention may then be prepared by treating the carrier material (powder or granulate), for example, by spraying, with one or more liquid, viscous-liquid, oily or waxy ingredients. Such compositions will generally be components of more complex products, rather than whole detergent products in their own right.

Detergent base powder containing zeolite MAP

According to a third embodiment of the invention, the zeolite MAP is incorporated in a detergent base powder containing detergent-active materials, and optionally other compatible ingredients such as supplementary builders, sodium silicate, fluorescers, and antiredeposition polymers. Such a base powder may be prepared by spray-drying, but non-tower methods such as dry mixing or granulation are also possible. The amount of zeolite MAP in the base powder may suitably range from 10 to 80 wt %.

The base powder may then be treated, for example, by spraying, with one or more liquid, viscous-liquid, oily or waxy ingredients.

The resulting particulate composition may represent a fully formulated detergent composition; or, if desired, further particulate ingredients may then be admixed (post-dosed), in the conventional manner, to arrive at the final product.

Zeolite MAP in high-bulk-density agglomerate

A fourth embodiment of the invention, which may be regarded as a variation of the first embodiment, is a particulate material of high bulk density prepared in a high-speed mixer/granulator. According to this embodiment, zeolite MAP (generally in powder form) and the liquid, viscous-liquid, oily or waxy ingredient are mixed and granulated, optionally together with other ingredients, in a high-speed mixer/granulator, to give an agglomerate of high bulk density.

It may be necessary to include a binder in order to obtain a satisfactory agglomerate. Suitable binders include polycarboxylate polymers, for example, polymers of acrylic and/or maleic acid, in aqueous solution; and aqueous solutions of inorganic salts, for example, sodium carbonate or sodium silicate. Detergent-active compounds may also act as binders; and some compositions will already contain ingredients, such as detergent-active compounds, that will render the addition of further binders unnecessary. Additional water may be needed to bring about agglomeration, and a subsequent drying step may also be required.

The product (agglomerate) may suitably contain from 20 to 80 wt % of zeolite MAP, from 15 to 40 wt % of the liquid, viscous-liquid, oily or waxy ingredient, and binder, water and optionally other ingredients to 100 wt %.

The process may be carried out in a high-speed batch mixer/granulator having both a stirring action and a cutting action, as described and claimed in EP 340 013A (Unilever). Preferably the stirrer and the cutter may be operated independently of one another, and at separately variable speeds. Such a mixer is capable of combining a high energy stirring input with a cutting action, but can also be used to provide other, gentler stirring regimes with or without the cutter in operation. It is thus a highly versatile and flexible piece of apparatus.

A preferred type of batch high-speed mixer/granulator is bowl-shaped and preferably has a substantially vertical stirrer axis. Especially preferred are mixers of the Fukae (Trade Mark) FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another, and at separately variable speeds.

As indicated previously, the Fukae mixer requires batch operation. Alternatively, continuous processes may be employed, for example, using a continuous high-speed mixer/granulator such as the Lödige (Trade Mark) Recycler, optionally followed by a moderate-speed continuous mixer/granulator such as the Lödige Ploughshare. Suitable processes are disclosed in EP 367 339A, EP 390 251A and EP 420 317A (Unilever).

In one variant of this embodiment of the invention, the high-speed mixer/granulator is used to effect in-situ neutralisation of an acid precursor of an anionic surfactant, for example, linear alkylbenzene sulphonic acid or a primary alcohol sulphuric acid, with a solid mixture including a neutralising alkaline salt (for example, sodium carbonate) and zeolite MAP. Processes of this kind are described and claimed in EP 352 135A and EP 420 317A (Unilever).

If a subsequent drying step is required, that may conveniently and efficiently be carried out in a fluid bed.

The granulate obtained typically has a bulk density of at least 700 g/liter. It may be used as a complete detergent composition in its own right, or may be admixed with other components or mixtures prepared separately to form a major or minor part of a final product.

The liquid, viscous-liquid, oily, or waxy ingredient

This ingredient may be any functional material that is desirably incorporated into particulate detergent compositions.

The ingredient may, for example, be a detergent-active compound (surfactant), which may be anionic, nonionic, zwitterionic, amphoteric or cationic.

The invention is especially useful for the incorporation of fluid or mobile surfactants or surfactant mixtures into detergent powders. It has been found of particular value for incorporating high levels of mobile nonionic surfactants, or mobile mixtures of anionic and nonionic surfactants, into detergent powders.

Nonionic surfactants are well-known in the art. Ethoxylated nonionic surfactants are especially preferred. Suitable examples include $C_{10}$–$C_{20}$ aliphatic alcohols ethoxylated with an average of from 1 to 20 moles of ethylene oxide per mole of alcohol; more especially, the $C_{12}$–$C_{15}$ primary and secondary aliphatic alcohols ethoxylated with an average of from 1 to 10 moles of ethylene oxide per mole of alcohol. The alcohols having an average degree of ethoxylation below 10 are more mobile than the more highly ethoxylated materials and they benefit particularly from the present invention.

The invention is also applicable to nonionic surfactants other than ethoxylates, for example, alkylpolyglycosides; O-alkanoyl glucosides as described in EP 423 968A (Unilever); and alkyl sulphoxides as described in our copending British Patent Application No. 91 16933.4.

Mobile mixtures of anionic and nonionic surfactants, and mixtures of nonionic surfactants with acid precursors of anionic surfactants, are described and claimed in EP 265 203B (Unilever).

An especially preferred liquid, viscous-liquid, oily, or waxy ingredient that can be used in the present invention is a mixture of an ethoxylated nonionic surfactant with a primary or secondary alcohol sulphate.

As mentioned previously in the context of the fourth embodiment of the invention the liquid, viscous-liquid, oily or waxy ingredient may also be an acid precursor of an anionic surfactant, for example, linear alkylbenzene sulphonic acid. In that case, neutralisation normally accompanies mixing, granulation or other process steps so that the final product contains the surfactant in neutralised, salt form.

Other ingredients that may be incorporated in particulate detergent compositions or components with the aid of the present invention include foam-controlling silicones, waxes or hydrocarbons; fabric softening compounds; enzymes; and perfumes.

Flow properties

Compositions of the invention have excellent flow properties even with very high proportions of liquid, viscous-liquid, oily or waxy ingredient.

For the purposes of the present invention, powder flow is defined in terms of the dynamic flow rate, in ml/s, measured by means of the following procedure. The apparatus used consists of a cylindrical glass tube having an internal diameter of 35 mm and a length of 600 mm. The tube is securely clamped in a position such that its longitudinal axis is vertical. Its lower end is terminated by means of a smooth cone of polyvinyl chloride having an internal angle of 15° and a lower outlet orifice of diameter 22.5 mm. A first beam sensor is positioned 150 mm above the outlet, and a second beam sensor is positioned 250 mm above the first sensor.

To determine the dynamic flow rate of a powder sample, the outlet orifice is temporarily closed, for example, by covering with a piece of card, and powder is poured through a funnel into the top of the cylinder until the powder level is about 10 cm higher than the upper sensor; a spacer between the funnel and the tube ensures that filling is uniform. The outlet is then opened and the time t (seconds) taken for the powder level to fall from the upper sensor to the lower sensor is measured electronically. The measurement is normally repeated two or three times and an average value taken. If V is the volume (ml) of the tube between the upper and lower sensors, the dynamic flow rate DFR (ml/s) is given by the following equation:

$$DFR = \frac{V}{t} \ ml/s$$

The averaging and calculation are carried out electronically and a direct read-out of the DFR value obtained.

Compositions and components of the present invention generally have dynamic flow rates of at least 90 ml/s, preferably at least 100 ml/s.

"Bleeding" of nonionic surfactant

The carrier materials used in accordance with the invention not only have a larger capacity than similar materials based on zeolite A for taking up liquid ingredients such as nonionic surfactants; they also exhibit reduced leakage or bleeding out of such ingredients during storage. In a detergent powder, bleeding of mobile ingredient such as nonionic surfactant can lead to pack penetration, giving internal and external staining of the pack, which is highly undesirable.

Other detergent ingredients

Particulate compositions of the invention may form the whole, or a major or minor part, of a detergent composition.

Fully formulated detergent compositions in accordance with the invention may contain any suitable ingredients normally encountered, for example, detergent-active compounds (surfactants) which may be anionic, nonionic, cationic, amphoteric or zwitterionic; fatty acid soaps; organic or inorganic builder salts in addition to zeolite MAP, including other zeolites such as A or X; other inorganic salts such as sodium silicate and sodium sulphate; antiredeposition agents such cellulose derivatives and acrylic/maleic polymers; fluorescers; bleaches, bleach precursors, and bleach stabilisers; enzymes; dyes; coloured speckles; and perfumes. This list is not intended to be exhaustive.

EXAMPLES

The invention is further illustrated by the following Examples, in which parts and percentages are by weight unless otherwise indicated. Examples identified by numbers are in accordance with the invention, while those identified by letters are comparative.

The zeolite MAP used in the Examples was prepared by a method similar to that described in Examples 1 to 3 of EP 384 070A (Unilever). Its silicon to aluminium ratio was 1.07. Its particle size ($d_{50}$) as measured by the Malvern Mastersizer was 0.8 micrometers.

Except where otherwise stated, the zeolite A used was Wessalith (Trade Mark) P powder ex Degussa.

The nonionic surfactants used were Synperonic (Trade Mark) A7 and A3 ex ICI, which are $C_{12}$–C15 alcohols ethoxylated respectively with an average of 7 and 3 moles of ethylene oxide.

The acrylic/maleic copolymer was Sokalan (Trade Mark) CP5 ex BASF.

Example 1, Comparative Examples A to E Samples of zeolite MAP (Example 1), and five different commercially available zeolite A samples (Comparative Examples A to E) were titrated with oil using the method described in BS 3483: Part B7: 1982. Each sample consisted of 100 g hydrated material having a water content of about 20 wt % (equivalent to 80 g of notional anhydrous material).

The zeolite A materials were as follows:

| Example | Trade name | Manufacturer |
|---|---|---|
| A | Wessalith* P | Degussa |
| B | Doucil* P | Crosfield |
| C | Birac* | Birac |
| D | Soprolit* | Montedison |
| E | IZL | Industrial Zeolites |

*Trade Mark

The oil absorption results were as follows:

| | Zeolite | Titration (g oil per sample) | % oil on product | ratio oil: anhydrous zeolite |
|---|---|---|---|---|
| 1 | MAP | 57 | 41.6 | 0.71 |
| A | A | 36 | 31.0 | 0.45 |
| B | A | 38 | 32.2 | 0.48 |
| C | A | 38 | 32.2 | 0.48 |
| D | A | 29 | 26.6 | 0.36 |
| E | A | 44 | 35.5 | 0.55 |

Example 2, Comparative Example F

Detergent base powders were prepared to the following formulations (in weight percent) by spray-drying aqueous slurries:

| | 2 | F |
|---|---|---|
| Linear alkylbenzene sulphonate | 12.20 | 12.20 |
| Nonionic surfactant 7EO | 5.60 | 5.60 |
| Soap | 3.40 | 3.40 |
| Zeolite 4A (as anhydrous*) | — | 36.40 |
| Zeolite MAP (as anhydrous*) | 36.40 | — |
| Acrylic/maleic copolymer | 5.50 | 5.50 |
| Sodium alkaline silicate | 0.80 | 0.80 |
| Sodium carbonate | 22.10 | 22.10 |
| SCMC | 1.00 | 1.00 |
| Fluorescer | 0.40 | 0.40 |
| Moisture (nominal)* | 12.40 | 12.40 |
| | 100.00 | 100.00 |

*The zeolites were used in hydrated form (45.50 wt %), but are quoted in terms of anhydrous material, the water of hydration being included in the amount shown for total moisture.

The bulk densities of these powders were as follows:

| Bulk density (g/liter) | 377 | 386 |
|---|---|---|

250 g samples of the powders were then sprayed with varying quantities of nonionic surfactant 3EO (liquid) in a rotating pan. After spray-on of nonionic surfactant, the resulting powders were left to stand for several hours and their dynamic flow rates were then measured.
The results were as follows:

| Nonionic surfactant added (g) | % nonionic surfactant (on product) | nonionic surfactant: zeolite (anh) ratio | dynamic flow rate (ml/s) 2 | F |
|---|---|---|---|---|
| 0 | 0 | — | 120 | 121 |
| 10 | 3.85 | 0.11 | 114 | 83 |
| 15 | 5.66 | 0.16 | — | 69 |
| 20 | 7.41 | 0.22 | 111 | 23 |
| 25 | 9.09 | 0.27 | 103 | — |
| 30 | 10.71 | 0.33 | 101 | — |
| 35 | 12.28 | 0.38 | 98 | — |
| 40 | 13.79 | 0.44 | 97 | — |
| 45 | 15.25 | 0.49 | 94 | — |
| 50 | 16.67 | 0.55 | 99 | — |
| 55 | 18.03 | 0.60 | 23 | — |

These results clearly show that the MAP-based powder was able to carry significantly higher amounts of nonionic surfactant before its flow was adversely affected.

Example 3, Comparative Example G

Example 2 was repeated using powders containing higher proportions of zeolite. The formulations were as follows:

| | 3 | G |
|---|---|---|
| Linear alkylbenzene sulphonate | 10.30 | 10.30 |
| Nonionic surfactant 7EO | 4.70 | 4.70 |
| Soap | 2.80 | 2.80 |
| Zeolite 4A (as anhydrous) | — | 43.10 |
| Zeolite MAP (as anhydrous) | 43.10 | — |
| Acrylic/maleic copolymer | 4.60 | 4.60 |
| Sodium alkaline silicate | 0.70 | 0.70 |
| Sodium carbonate | 18.70 | 18.70 |
| SCMC | 0.90 | 0.90 |
| Fluorescer | 0.30 | 0.30 |
| Water (nominal) | 13.90 | 13.90 |
| | 100.00 | 100.00 |

The bulk densities of these powders were as follows:

| Bulk density (g/liter) | 370 | 397 |
|---|---|---|

The flow results were as follows:

| Nonionic surfactant added (g) | % nonionic surfactant (on product) | nonionic surfactant: zeolite (anh) ratio | dynamic flow rate (ml/s) 3 | G |
|---|---|---|---|---|
| 0 | 0 | — | 122 | 120 |
| 28 | 10.07 | 0.23 | — | 82 |
| 36 | 12.59 | 0.33 | 118 | 83 |
| 40 | 13.79 | 0.37 | 114 | 86 |

-continued

| Nonionic surfactant added (g) | % nonionic surfactant (on product) | nonionic surfactant: zeolite (anh) ratio | dynamic flow rate (ml/s) 3 | G |
|---|---|---|---|---|
| 44 | 14.97 | 0.41 | 114 | 55 |
| 60 | 19.35 | 0.56 | 112 | — |
| 68 | 21.38 | 0.63 | 107 | — |
| 76 | 23.17 | 0.71 | 24 | — |

Again, the results clearly show the improved carrying capacity for nonionic surfactant of the zeolite MAP-based powder.

Example 4, Comparative Example H

Detergent base powders of high bulk density were prepared by granulating and densifying the spray-dried base powders of Examples 3 and G using a Fukae (Trade Mark) FS-30 high-speed mixer/granulator, in the presence of nonionic surfactant (3EO). The mixer was operated at a stirrer speed of 200 rpm and a cutter speed of 3000 rpm, the temperature being controlled at 60° C. by means of a water jacket; the granulation time was 2 minutes. The amount of nonionic surfactant added was adjusted to give satisfactory granulation.

The final compositions (in weight percent) and their properties were as follows:

| | 4 | H |
|---|---|---|
| Base powder (Example 3) | 86.10 | — |
| Base powder (Example G) | — | 90.80 |
| Nonionic surfactant 3EO | 13.90 | 9.20 |
| | 100.00 | 100.00 |
| Added nonionic:zeolite ratio | 0.37 | 0.23 |
| Bulk density (g/l) | 810 | 830 |
| Dynamic flow rate (ml/s) | 120 | 120 |
| Average particle size (micrometers) | 450 | 420 |

Example 5, Comparative Example J

Powders of high bulk density having the formulations given below (in weight percent) were prepared by a non-tower process using the Fukae (Trade Mark) FS-30 high-speed mixer/granulator.

| | 5 | J |
|---|---|---|
| Zeolite A powder (hydrated*) | — | 68.49 |
| Zeolite MAP powder (hydrated*) | 63.29 | — |
| Acrylic/maleic copolymer (40 wt % aqueous solution) | 6.33 | 6.85 |
| Nonionic surfactant 7EO | 24.05 | 20.55 |
| Water | 6.33 | 4.11 |
| | 100.00 | 100.00 |

*Water content 20 wt %.

The zeolite powder was first added to the mixer/granulator, then the aqueous polymer solution and liquid nonionic surfactant were added with the stirrer rotating at 100 rpm and the cutter at 3000 rpm. The temperature of the equipment was controlled to 25° C. by means of a water jacket. The quantity of water required to effect agglomeration was then added, and the mixer was operated with the stirrer rotating at 200 rpm and the cutter at 3000 rpm. The time required in each case was 1.5 minutes.

The products were then dried in a fluid bed dryer, to give dense, free-flowing granules having the composition and properties shown below.

| | 5 | J |
|---|---|---|
| Nonionic surfactant 7EO | 26.8 | 22.4 |
| Zeolite A (as anhydrous) | — | 59.7 |
| Zeolite MAP (as anhydrous) | 56.3 | — |
| Acrylic/maleic copolymer | 2.8 | 3.0 |
| Water (nominal) | 14.1 | 14.9 |
| Nonionic:zeolite ratio | 0.47 | 0.37 |
| Bulk density (g/liter) | 845 | 870 |
| Dynamic flow rate (ml/s) | 147 | 146 |
| Average particle size (micrometers) | 1350 | 1160 |

Examples 6 and 7, Comparative Example K

These Examples show the reduced "bleeding" of nonionic surfactant from carrier materials comprising zeolite MAP, as compared with carrier materials comprising zeolite 4A.

The test used gives an estimate of the degree of bleeding during a three week storage period at 37° C. by measuring the amount of nonionic surfactant absorbed by preweighed filter papers placed near the top and bottom of a powder column.

A 400 g sample of each powder was weighed out. Powder was poured to a depth of 1 cm into the base of a cylindrical container of diameter 15 cm, and an accurately weighed filter paper (Schleicher and Schull No. 589) placed on top of the powder. More powder was added to an approximate depth of 5 cm above the filter paper, and then covered with a second accurately weighed filter paper. The remainder of the powder sample was then used to cover the second filter paper. The container was tightly sealed and stored in a dry atmosphere at 37° C. for 3 weeks. After the storage period the filter papers were removed and weighed, the increase in weight of each calculated, and the values for the two increases averaged.

The powders tested were all prepared by granulation in the Fukae mixer as described in Example 5.

Compositions and results are shown in the Table. The nonionic surfactant was Synperonic A3. Amounts are in parts by weight.

| | K | 6 | 7 |
|---|---|---|---|
| Zeolite 4A (anhydr) | 32 | — | — |
| Zeolite MAP (anhydr) | — | 32 | 32 |
| Sodium carbonate | 15 | — | 7.5 |
| Nonionic surfactant 3EO | 17 | 17 | 17 |
| Ratio nonionic:zeolite | 0.53 | 0.53 | 0.53 |
| Increase in weight of filter paper (g) | 88 | 59 | 57 |

Using zeolite 4A, it was necessary to include sodium carbonate in order to achieve successful granulation (Comparative Example K), whereas with the same amount of zeolite MAP no sodium carbonate was required (Example 6). Comparison of Examples 6 and 7 show that sodium carbonate had little or no effect on bleeding, so that it was not the absence of sodium carbonate that was responsible for the better results obtained with zeolite MAP.

We claim:

1. A method of using zeolite P having a silicon to aluminium ratio not greater than 1.33 (zeolite MAP) as a carrier material for a liquid, viscous-liquid or oily nonionic surfactant in a free-flowing particulate detergent composition or component therefor, which method comprises treating (i) a particulate carrier material comprising from 10 to 100 wt % (anhydrous basis) of zeolite MAP and selected from the group consisting of:
  (a) zeolite MAP in powder form,
  (b) a spray-dried, dry-mixed or granulated granular material comprising from 10 to 80 wt % of zeolite MAP and from 20 to 90 wt % (based on the carrier material) of other compatible detergent ingredients optionally including one or more detergent active compounds but excluding liquid, viscous liquid or oily nonionic surfactants, with (ii) a liquid, viscous-liquid or oily nonionic surfactant, the weight ratio of the liquid, viscous-liquid or oily nonionic surfactant to the particulate carrier material being within the range of from 0.1:1 to 0.75:1.

2. A method as claimed in claim 1 wherein the weight ratio of the liquid, viscous-liquid or oily nonionic surfactant to the zeolite MAP is within the range of from 0.1:1 to 1:1.

3. A method as claimed in claim 1, wherein the ratio of liquid, viscous-liquid or oily nonionic surfactant to the zeolite MAP is at least 0.35:1.

4. A method as claimed in claim 3, wherein the ratio of liquid, viscous-liquid or oily nonionic surfactant to the zeolite MAP is at least 0.45:1.

5. A method as claimed in claim 1, wherein the zeolite MAP has a particle size $d_{50}$ within the range of from 0.1 to 5.0 micrometers wherein the quantity $d_{50}$ indicates that 50 wt % of particles have a diameter smaller than that figure.

6. A method as claimed in claim 5, wherein the zeolite MAP has a particle size $d_{50}$ within the range of from 0.4 to 1.0 micrometers.

7. A method as claimed in claim 1, wherein the zeolite MAP has a particle size distribution such that at least 90 wt % are smaller than 10 micrometers, at least 85 wt % are smaller than 6 micrometers and at least 80 wt % are smaller than 5 micrometers.

8. A method as claimed in claim 7, wherein the zeolite MAP has a particle size distribution such that at least 95 wt % are smaller than 10 micrometers, at least 90 wt % are smaller than 6 micrometers and at least 85 wt % are smaller than 5 micrometers.

9. A method as claimed in claim 1, which comprises from 2 to 45 wt % of the ingredient (ii), based on the total of the carrier material (i) and the ingredient (ii).

10. A method as claimed in claim 1, wherein the particulate carrier material comprises from 50 to 80 wt % (based on the carrier material) of zeolite MAP.

11. A method as claimed in claim 1, wherein the liquid, viscous-liquid or oily nonionic surfactant is sprayed in liquid or liquefied form onto the particulate carrier material.

12. A method as claimed in claim 1, which comprises mixing and granulating the zeolite MAP, the liquid, viscous-liquid, oily or waxy ingredient, and optionally other ingredients, in a high-speed mixer/granulator.

13. A method as claimed in claim 1, wherein the nonionic surfactant is a $C_{10}$–$C_{20}$ aliphatic alcohol ethoxylated with an average of from 1 to 20 moles of ethylene oxide per mole of alcohol.

14. A method as claimed in claim 13, wherein the nonionic surfactant is a $C_{12}$–$C_{15}$ is primary or secondary aliphatic alcohol ethoxylated with an average of from 1 to 10 moles of ethylene oxide per mole of alcohol.

15. A detergent composition or component prepared by a method as claimed in claim 1, which comprises from 20 to 80 wt % (based on the composition or component) of zeolite MAP, from 15 to 40 wt % of the liquid, viscous-liquid or oily nonionic surfactant, and optionally binder, water and other ingredients to 100 wt %.

16. A detergent composition or component as claimed in claim 15, having a bulk density of at least 700 g/l.

* * * * *